United States Patent [19]

Upchurch

[11] Patent Number: 4,639,842

[45] Date of Patent: Jan. 27, 1987

[54] TROUBLE LIGHT WITH ROTATABLE ATTACHING MEANS

[75] Inventor: James E. Upchurch, Indianapolis, Ind.

[73] Assignee: Woods Wire Products, Inc., Carmel, Ind.

[21] Appl. No.: 792,029

[22] Filed: Oct. 28, 1985

[51] Int. Cl.[4] ..... F21V 15/00

[52] U.S. Cl. ..... 362/376; 362/377; 362/451

[58] Field of Search ..... 362/376, 377, 451

[56] References Cited

U.S. PATENT DOCUMENTS

| | | | |
|---|---|---|---|
| 4,136,381 | 1/1979 | Bone | 362/376 |
| 4,236,195 | 11/1980 | Konacik | 362/377 |
| 4,298,922 | 11/1981 | Hardwick | 362/376 |
| 4,369,487 | 1/1983 | Carlow | 362/376 |

*Primary Examiner*—E. Rollins Cross

*Attorney, Agent, or Firm*—Woodard, Weikart, Emhardt & Naughton

[57] ABSTRACT

A trouble light which has at the end opposite to the cage a hook that is rotatably mounted to the handle of the trouble light. The rotatable mounting is achieved by the use of a rotation assembly inserted through a hole in the end of the handle of the trouble light. The rotation assembly includes two discs. The first disc is of greater diameter than diameter of the hole in the handle but of lesser diameter than the internal diameter of the handle, and the second disc is of greater diameter than the hole in the handle and of diameter approximating the outside diameter of the handle. The rotation assembly also includes an intermediate cylindrical portion attaching the two discs. The cylindrical intermediate portion has an outside diameter approximating the diameter of the hole in the handle of the trouble light. The length of the cylindrical intermediate portion approximates the thickness of the end wall of the handle so that the adjacent surfaces of the two discs are in frictional contact with the external and internal walls of the hollow handle. A hole sized to allow an electrical cord to be inserted therethrough extends through the rotation assembly. On the circumferential edge of the rotation assembly, a plurality of ears, co-planar with the second disc, extend outwardly to allow for easy rotation of the assembly. Near a circumferential edge, a hook is fixedly attached to the rotation assembly to allow the trouble light to be hooked to an external object and then rotated in the direction of desired illumination.

16 Claims, 8 Drawing Figures

TROUBLE LIGHT WITH ROTATABLE ATTACHING MEANS

BACKGROUND OF THE INVENTION

Field of the Invention

This invention is in the field of light fixtures and more specifically, trouble lights. Trouble lights are lights comprised of a handle into which a wire is run at one end and at the other end a socket is placed to allow for the use of an incandescent light bulb. At the same end as the socket a cage is attached to protect the bulb from damage and also to reflect light in a single general direction. Trouble lights are old in the art and many designs are currently sold. Most trouble lights marketed today attempt to provide for hand free operation by providing a hook that is fixedly attached to the protective cage or cover. The disadvantage with the current type of design is that with a fixedly attached hook it is often difficult to find an object to attach the light to orient the light in the direction of desired illumination. My invention is an improved design upon the trouble light, providing for an attaching means at the end of the handle opposite to the cage. The attaching means is rotatable so that the light can be oriented in any direction once it is attached to an external object.

SUMMARY OF THE INVENTION

One embodiment of the present invention is a trouble light, having an elongate handle generally shaped to be easily held in the hand, the handle having two ends, one end having a socket in which a light bulb may be placed and also having a protective cage attached thereto to protect the light bulb once inserted, while the other end is designed to allow an electrical cord to enter the handle so as to provide for wiring of switches and the light socket, also attached to that end is a rotatably mounted means of attaching the trouble light to an external surface, the means having a hole passing through it to allow a wire to pass through the means into the handle, and further having a plurality of ears or flanges to allow for easy rotation of the rotatable attachment means.

It is an object of the present invention to provide for an improved trouble light design.

It is a further object of the present invention to provide a trouble light which may be hung on any available object and then be oriented so as to illuminate a desired work area.

Related objects and advantages of the present invention will be apparent from the following description.

DESCRIPTION OF THE PREFERRED EMBODIMENT

Figure 1:
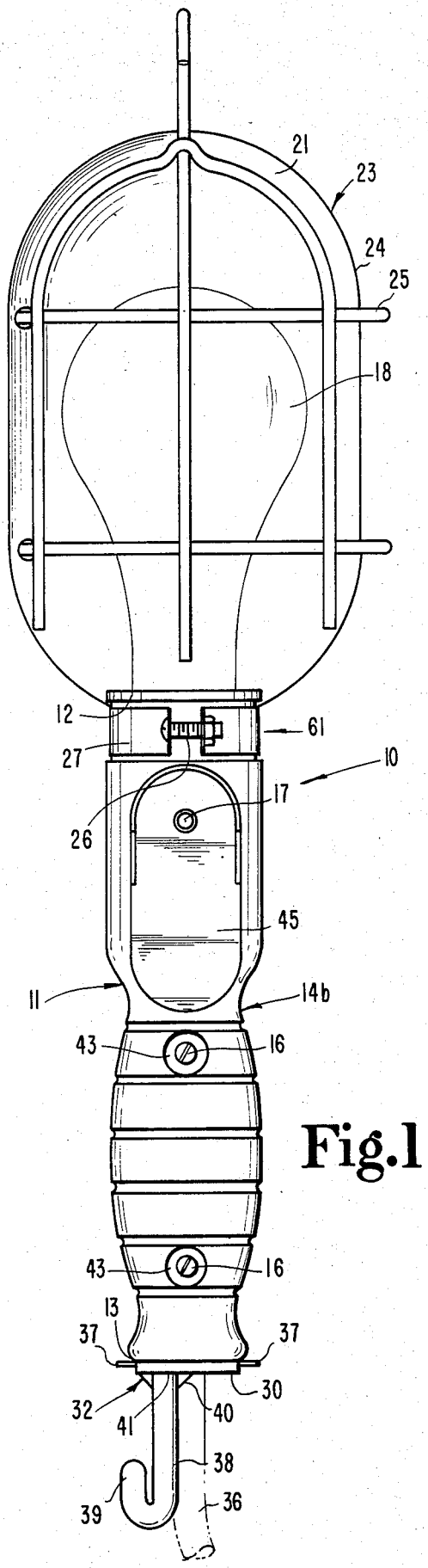
FIG. 1 is a frontal view of the trouble light assembly.
Figure 2:
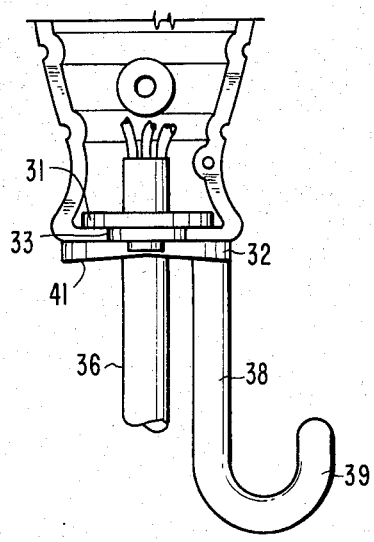
FIG. 2 is a fragmentary cross sectional view of the end which provides for a rotatably mounted means of attaching the trouble light to an external object.
Figure 3:
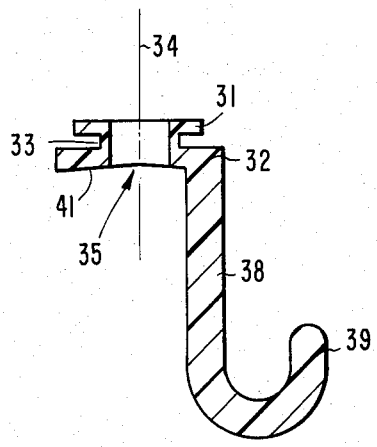
FIG. 3 is a cross sectional view of the means of attaching the trouble light to an external object.

For the purpose of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 6:
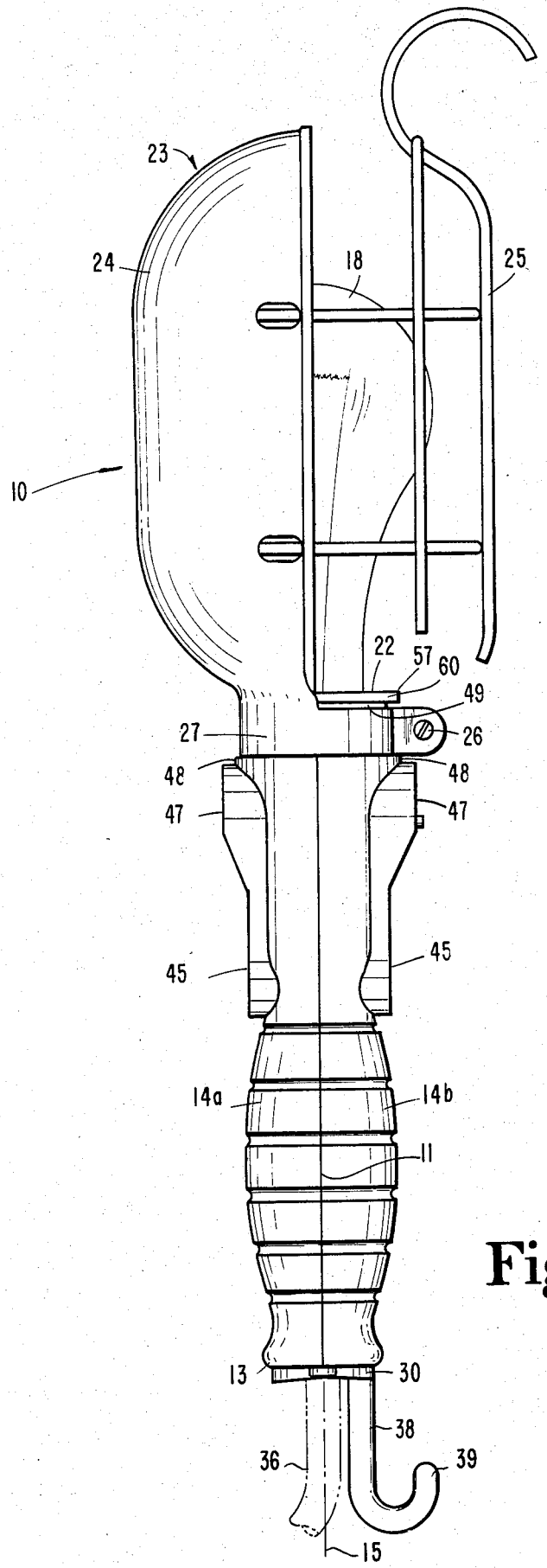
FIG. 6 is a side view of the trouble light assembly.

Referring now more particularly to FIG. 1, there is shown a trouble light 10 having a generally cylindrical, hollow, elongate handle 11 shaped to be comfortably held in the hand, and having a distal end 12 and proximate end 13. The handle 11 is of two piece construction (FIG. 6) with the two half portions **14*a* and 14*b* generally symmetrical about a longitudinal axis 15 and fixedly attached to one another by means of screws 16. The handle 11 is constructued to allow for operation of a two-position switch 17 controlling the flow of current to an incandescent light bulb 18. The handle 11 also has a female electrical connector constructed therein to allow for operation of other electrical devices by plugging into the female connector in the handle 11. The handle 11 has electrical circuitry 20 within its hollow interior providing electrical current to the electrical female connector and the two-position switch 17 from an external source entering the handle 11 from its proximate end 13. The handle also has an incandescent light bulb socket 22 secured in the distal end 12 of the handle 11**.

The trouble light 10 also has a cage 23 attached to the distal end 12 of the handle 11. The cage 23 is sized to encompass an incandescent light bulb therein and designed to protect the bulb from breakage during use and to direct the light emitting from the bulb. The cage 23 is of two-piece construction, one piece 24 is solid opaque with its internal surface 21 being semi-reflective, the second piece is a rigid grid 25 designed to allow light to pass through it. Grid 25 is hingedly attached to the first piece 24 to allow the grid 25 to be securely attached to the first piece 24 when the unit is in use and to allow the second piece to open to allow easy access to the incandescent bulb. The cage 23 is attached to the handle 11 by means of a nut and bolt 26 through a band 27 attached to and protruding from the first piece 24 and wrapping around the handle 11.

Half portion **14*a* of handle 11 will now be more particularly described with the understanding that the description of 14*a* applies to half portion 14*b* with the exception that half portion 14*a* includes three holes, a positive prong receiving hole 42P, a negative prong receiving hole 42N, and a grounded prong receiving hole 42G, therein to allow for insertion of a polarized three-prong electrical plug, which are not included in half portion 14*b*. Also half portion 14*b* has two recesses 43 therein to allow for screws 16 to be inserted into the half portions without the heads of the screws extending above the external surface of half portion 14*b* while half portion 14*a* has no such recesses. Half portion 14*a* also contains a grounding strip hole 50 not found in half portion 14*b*. Half portions 14*a* and 14*b*** are divided by a plane passing through the longitudinal axis of the handle.

Half portion 14*a* is an elongated generally semi-cylindrical shell. The external surface 44 of the half portion is shaped to allow for the handle 11 to be easily held within the hand. A flat surface 45 is located near the distal end 12 of the half portion 14*a* on the external surface 44. The flat surface 45 is symmetrical about a plane passing through the longitudinal axis 15 of the handle 11 perpendicular to the plane which divides the handle into half portions. Flat surface 45 is provided to allow for a male three prong polarized electrical connector to seat firmly within three holes 42P, 42N and 42G provided in the flat surface 45. Also located upon the flat surface is a switch hole 46 to allow for one end of a two-position switch 17 to be inserted therethrough. On the external edge of flat surface 45 a flange 47 is formed to prevent the two-position switch 17 from being inadvertently activated when the lamp is laid upon the ground. At the distal end 12 of the half portion 14*a*, the diameter of the half portion's external surface is decreased so that an external step 48 is formed between the remainder of the external surface and the decreased diameter surface area 49. The decreased diameter surface area 49 is provided to allow the band 27 from cage 23 to be secured thereabouts. A grounding strip hole 50 is located in the decreased diameter surface area 49 near the external step 48. Grounding strip 51 extends through hole 50 grounding metal cage 23 when the cage is clamped to handle 11.

Figure 5:
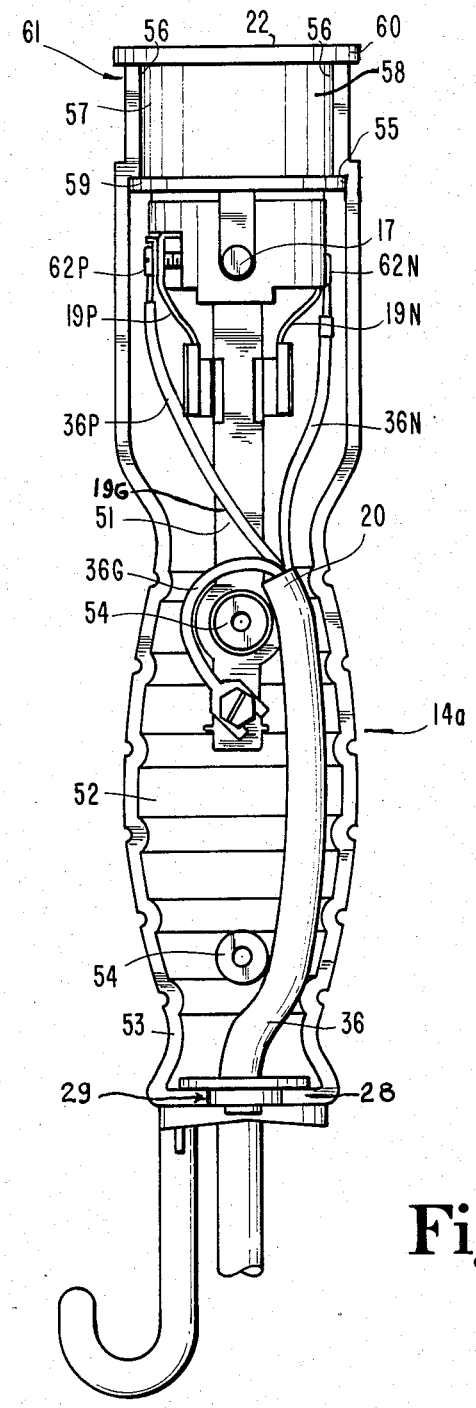
FIG. 5 is a view of one piece of the two piece handle showing the internal structure of the handle when the rotatable attaching means, female electrical connector, switch, light socket and collar are in place.

The internal surface 52 (FIG. 5) of the half portion 14*a* is shaped generally the same as the external surface 44 so that a wall 53 of generally uniform thickness exists throughout the handle 11. Contained within the internal portion are two bosses 54 extending radially from the internal surface 52 towards the longitudinal axis 15 of the handle perpendicular to the plane dividing the handle 11. The bosses 54 allow for screws 16 to be inserted therethrough to connect the two half portions 14*a* and 14*b* together. At the distal end 12 of half portion 14*a*, the internal surface is of a lesser diameter than the immediately adjacent internal surface thereby creating an internal step 55 and a decreased diameter internal surface area 56. The distal end 12 of half portion 14*a* is open while the proximate end 13 of half portion 14*a* is partially enclosed by an end wall 28 that has a semi-circular opening 29 therethrough.

Within the hollow interior of handle 11 there is contained a common three wire extension cord 36 which enters the handle 11 from the proximate end 13 through the hole 29 in the end wall. The three wires, positive wire 36P, negative wire 36N and grounded wire 36G, within this extension cord are connected to a three prong female electrical connector. The three prong female electrical connector consists of three parts. A first part 19P is located adjacent the positive prong hole 42P in the half portion 14*a* of the handle 11 to allow for the positive prong of a three prong male electrical connector to come in contact therewith when inserted. First part 19P is further connected to the positive wire 36P of the three wire extension cord 36 and the positive terminal 62P of switch 17. A second part 19N is located adjacent to the negative prong receiving hole 42N in the half portion 14*a* to allow for the negative prong of a three prong male electrical connector to come in contact therewith when inserted. Second part 19N is also connected to the negative wire 36N of the three wire extension cord 36 and the negative terminal 62N of switch 17. Third part 19G is the internally located end of the grounding strip 51. Third part 19G is a long strip of conductive material, and is located adjacent to the grounded prong receiving hole 42G in the half portion 14*a* to allow for the grounded prong of a three prong male electrical connector to come in contact therewith when inserted. Third part 19G is also connected to the ground wire 36G of the three wire electrical extension cord 36. Third part 19G extends through the grounding strip hole 50 in the distal end 12 of half portion 14*a*. When the band 27 that holds metallic cage 23 in place is attached to the distal end 12 of the handle 11, the cage 23 is in conductive communication with the grounding strip 51 and is thereby grounded.

Figure 7A:
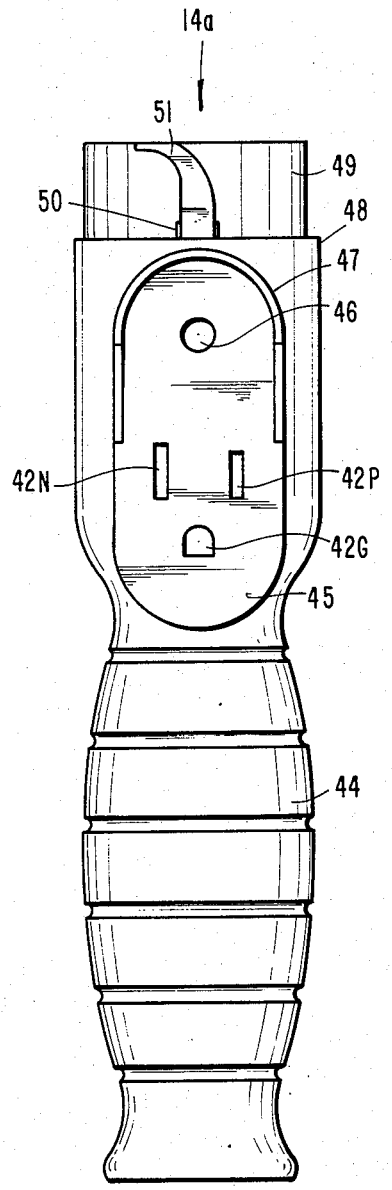
FIG. 7A is a view of the external surface of one half portion of the handle of the trouble light.
Figure 7B:
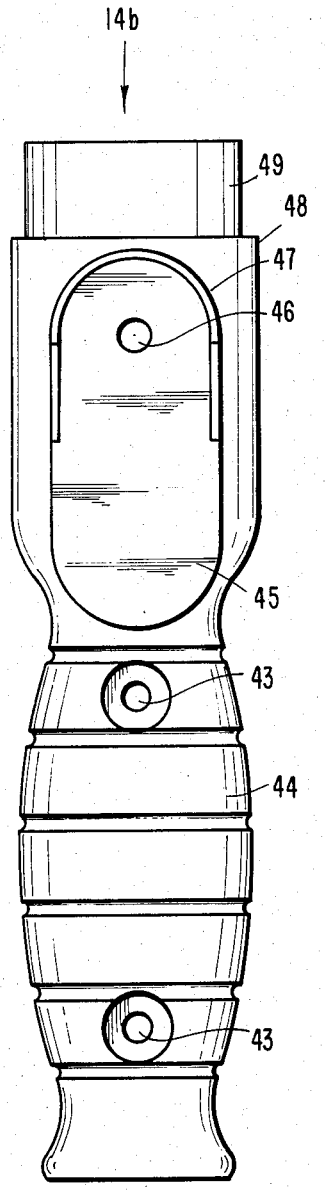
FIG. 7B is a view of the external surface of a second half portion of the handle of the trouble light.

First part 19P and second part 19N are attached to the positive terminal 62P and the negative terminal 62N of the two-position switch 17 The two-position switch 17 and the incandescent light socket 22 are joined and are in conductive communication with one another so that current entering the switch 17 when it is in the "on" position is communicated to the socket while no current is communicated when the switch is in its "off" position. The socket 22 is of lesser diameter than the switch 17. Switch 17 fits within the half portion 14*a*, while the socket 22 fits snugly within a collar 57. The collar 57 is inserted in the distal end 12 of the half portion 14*a* and is generally cylindrical with flanges 59 and 60 on each end. The first end flange 59 is sized to fit within the larger internal diameter of the half portion 14*a* at the distal end 12 wile the second end flange 60 is sized to extend slightly beyond the outside diameter of the distal end 12 of the handle 11. The outside diameter of the cylindrical portion 58 is sized to fit snugly within the decreased diameter internal surface area 56 at the distal end 12 of the half portion 14*a*, while the inside diameter of the collar 56 is sized to fit snugly around the incandescent light bulb socket 22. The second end flange 60 of collar 57 helps to form a channel 61 with the external step 48 (FIG. 7A) of the half portion 14*a* so that when the band 27 from cage 23 is secured thereabouts it will not slip off the handle 11.

Figure 4:
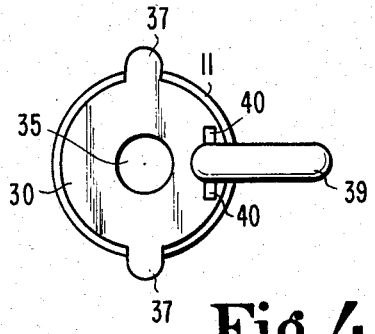
FIG. 4 is an end view of the assembly.

Located at the proximate end 13 of the handle 11 is an end wall 28 enclosing the proximate end 13. A hole 29, sized to allow a rotatable attaching means 30 (FIG. 4) to be set therein, passes through the end wall 28. The rotatable attaching means 30 consists of two discs, a first disc 31 and a second disc 32, and a cylindrical intermediate portion 33, fixedly attached or molded to each other concentrically about the same longitudinal axis 34. Axis 34 passes through the foci of discs 31 and 32 and the center of the cylindrical intermediate portion 33. The first disc 31 is sized to fit within the inside diameter of the hollow handle 11. The cylindrical intermediate portion 33, located between the first disc 31 and the second disc 32 is sized to fit snugly within the hole 29 in the end wall 28 enclosing the proximate end 13 of the hollow handle 11. The cylindrical intermediate portion 33 is of smaller diameter than the first disc 31 and second disc 32. The second disc 32 is sized to approximate the outside diameter of the hollow handle 11. The rotatable attaching means 30 is arranged so that the length of the cylindrical intermediate portion 33 approximates the width of the end wall 28 enclosing the proximate end 13 of the hollow handle 11, thereby allowing the adjacent surfaces of the first disc 31 and second disc 32 to be in frictional contact with the end wall 28 enclosing the proximate end 13 of the hollow handle 11.

The rotatable attaching means 30 has a hole 35 passing through it concentric about its longitudinal axis 34. The hole 35 is sized to allow electrical cord 36 to pass through it from the outside to the interior of the hollow handle 11.

The second disc 32 may also have a plurality of ears 37 diametrically attached to the edge of the second disc 32, thereby providing for easy manual rotation of the rotatable attaching means 30 within the handle 11. Attached to the outside surface and near the external edge of the surface of the second disc is a shaft 38 parallel to the longitudinal axis 15 of the handle 11. Ears 37 and shank 38 are located relative to one another so that a diameter line through the ears 37 and the focus of second disc 32 is perpendicular to a radial line from the base of shank 38 to the focus of second disc 32. The shaft 38 is curved to form a hook 39 to allow attachment of the trouble light to a convenient object. The shaft 30 may also have a fillet 40 at the point of attachment to the second disc. The external surface of the second disc may also have a bead 41 to aid in removal of the disc from the mold in which it is formed.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed:

1. A light comprising:

a generally cylindrical, hollow, elongated handle shaped to be comfortably held in the hand and having a distal end and a proximate end, said handle having a first longitudinal axis;

an incandescent light bulb socket located in the distal end;

said distal end being open and internally sized to receive the incandescent light bulb socket, said proximate end having an end wall enclosing said proximate end;

switch means electrically connected to said incandescent light bulb socket for controlling the flow of electricity to said incandescent light bulb socket;

wiring means connectable to an external electric source, designed and arranged to supply electricity to said switch means;

a two-piece cage sized to permit an incandescent light bulb to be inserted therein, said cage having a first piece being manufactured of opaque material and being designed and arranged to protect an incandescent light bulb inserted in said socket and reflect the light emitted therefrom, said cage having a second piece and being of a grid design to allow light from said bulb to emit therethrough;

an attachment means for attaching said cage to the distal end of said handle;

a hanging means for hanging said light; and, rotatable mounting means for rotatably mounting the hanging means to the end wall and configured to allow the light assembly to be hung with said electrical socket therebeneath opening downward wherein the rotatable mounting means for rotatably mounting the hanging means comprises:

receiving means including a hole in the end wall enclosing the proximate end of said handle, sized to allow an electrical cord to pass therethrough, said hole being concentric about the longitudinal axis of the handle; and further comprising a first disc and a second disc;

a cylindrical intermediate portion integrally joining said first disc and said second disc to form a rotation assembly, said rotation assembly having a second longitudinal axis and being concentric about said second axis;

said first disc and second disc having outside diameters greater than the outside diameter of said cylindrical intermediate portion;

said first disc being sized to fit within the inside diameter of said handle, said cylindrical intermediate portion having an outside diameter sized to fit within the hole in the proximate end of said handle, said second disc having an outside diameter which approximates the outside diameter of said handle, said cylindrical intermediate portion having a length slightly greater than the thickness of the end wall enclosing the proximate end of said handle to allow for the sides of the first disc and second disc to be in frictional contact with the end wall of said handle; and, said rotation assembly seated in the hole in the proximate end of said handle so that the sides of the first disc and second disc are in frictional contact with the wall enclosing the proximate end of said handle.

2. The apparatus of claim 1 wherein the hanging means is a hook attached to the circumferential edge of said second disc, said hook having a shank parallel to said first longitudinal axis of said handle, the shank having a bend to form the hook.

3. The apparatus of claim 2 wherein said rotation assembly includes ears attached to the circumferential edge of said second disc to aid in rotating the rotation assembly by hand.

4. The apparatus of claim 1 wherein said rotation assembly includes a second hole passing through the first disc, second disc and the cylindrical intermediate portion, said second hole being concentric about said second longitudinal axis of said rotation assembly and being sized to allow an electrical cord from an external electrical source to fit loosely therethrough.

5. The apparatus of claim 2 wherein there is a hole passing through the first disc, second disc and the cylindrical intermediate portion, said hole being concentric about said second longitudinal axis of said rotation assembly and being sized to allow an electrical cord from an external electrical source to fit loosely therethrough.

6. The apparatus of claim 3 wherein there is a hole passing through the first disc, second disc and the cylindrical intermediate portion, said hole being concentric about said second longitudinal axis of said rotation assembly and being sized to allow an electrical cord from an external electrical source to fit loosely therethrough.

7. The apparatus of claim 6 wherein the ears are diametrically opposed to one another so that a first diameter line extending between the ears passes through said second axis, said ears being located relative to the hook so that a second line connecting the base of said hook to said second axis is perpendicular to said first diameter line.

8. An extension electrical light comprising:

a handle shaped plastic main body configured to be grasped and held in one's hand, said main body being hollow with a first end and an opposite second end, said first end and said second end open in opposite directions;

an electrical female socket mounted to said first end and opening outwardly to mountingly receive a light bulb therein;

a light bulb protective shield mounted to said handle adjacent said socket to extend around said light bulb;

an electrical switch electrically connected to said socket and mounted within said handle between said first end and said second end having a control extending outwardly thereof for operation of said switch;

an electrical extension cord electrically connected to said socket and extending through said handle and out said second end; and, a hanger movably mounted to said handle at said second end, said hanger and said second end being configured to provide a passage for said extension cord to extend therethrough with said hanger being movable around said cord without interfering therewith, thereby allowing controlled orientation of the light.

9. The apparatus of claim 8 wherein said hanger comprises:

a first disc and a second disc;

a cylindrical intermediate portion integrally joining said first disc and said second disc to form a rotation assembly;

said rotation assembly having a second longitudinal axis and being concentric about said second axis;

said first disc and second disc having outside diameters greater than the outside diameter of said cylindrical intermediate portion;

said first disc being sized to fit within the inside diameter of said handle, said cylindrical intermediate portion having an outside diameter sized to fit within a hole in the second end of said handle, said second disc having an outside diameter which approximates the outside diameter of said handle, said cylindrical intermediate portion having a length slightly greater than the thickness of an end wall enclosing the second end of said handle to allow for the sides of the first disc and second disc to be in frictional contact with the second end of said handle, said rotation assembly seated in a hole in the second end of said handle so that the sides of the first disc and second disc are in frictional contact with the second end of said handle.

10. The apparatus of claim 9 wherein the hanger further comprises a hook attached to the circumferential edge of said second disc, said hook having a shank parallel to said second longitudinal axis, the shank having a bend to form the hook.

11. The apparatus of claim 10 wherein said hanger includes ears attached to the circumferential edge of said second disc to aid in rotating the hanger by hand.

12. The apparatus of claim 11 wherein said hanger includes a second hole passing through the first disc, second disc and the cylindrical intermediate portion, said second hole being concentric about said second longitudinal axis of said rotation assembly and being sized to allow an electrical cord from an external electrical source to fit loosely therethrough.

13. The apparatus of claim 12 wherein the ears are diametrically opposed to one another so that a first diameter line extending between the ears passes through said second axis, said ears being located relative to the hook so that a second line connecting the base of said hook to said second axis is perpendicular to said first diameter line.

14. An extension electrical light comprising:

a handle shaped main body configured to be grasped and held in one's hand, said main body being hollow with a first end and an opposite second end, said first end and said second end open in opposite directions;

an electrical female socket mounted to said first end and opening outwardly to mountingly receive a light bulb therein;

a light bulb protective shield mounted to said handle adjacent said socket to extend around said light bulb;

an electrical switch electrically connected to said socket and having a control for operation of said switch;

an electrical extension cord electrically connected to said socket and extending through said handle and out said second end; and, a hanger movable mounted to said handle at said second end, said hanger and said second end being configured to provide a passage for said extension cord to extend therethrough with said hanger being movable around said cord without interfering therewith, thereby allowing controlled orientation of the light.

15. The apparatus of claim 14 wherein said hanger comprises:

receiving means including a hole in an end wall partially enclosing said second end, sized to allow an electrical cord to pass therethrough; and further comprising a first wall engaging means for frictionally engaging said end wall and a second wall engaging means for frictionally engaging said end wall;

an intermediate portion integrally joining said first wall engaging means and said second wall engaging means to form a rotation assembly, said first wall engaging means and second wall engaging means having greater maximum radial dimensions than the maximum radial dimension of said intermediate portion;

said intermediate portion being sized to fit within the hole in the proximate end of said handle, said intermediate portion having a length sufficient to allow for the first wall engaging means and second wall engaging means to be in frictional contact with the end wall of said handle; and, said rotation assembly seated in the hole in the second end of said handle so that the first wall engaging means and second wall engaging means are in frictional contact with the wall enclosing the second end of said handle.

16. The apparatus of claim 14 wherein said rotatable mounting means comprises:

receiving means including a hole in an end wall partially enclosing the second end of said handle, sized to allow an electrical cord to pass therethrough; and further comprising a first wall engaging means for frictionally engaging said end wall;

said first wall engaging means having greater maximum radial dimensions than the maximum radial dimension of said hole in the end wall; and, said first wall engaging means being sized to fit within the hollow handle while in frictional contact with the end wall of said handle.

* * * * *